United States Patent [19]

Cantwell et al.

[11] 3,935,607

[45] Feb. 3, 1976

[54] INFLATABLE BOAT

[75] Inventors: Robert Roger Cantwell, New Haven; Harold J. Pohl, Washington, both of Mo.

[73] Assignee: Kellwood Company, St. Louis, Mo.

[22] Filed: Aug. 26, 1974

[21] Appl. No.: 500,320

[52] U.S. Cl. ..... 9/2 A; 9/11 A

[51] Int. Cl.² ..... B63B 7/08

[58] Field of Search ..... 9/2 A, 11 R, 11 A, 3, 13, 9/2 R, 2 C

[56] References Cited

UNITED STATES PATENTS

| | | | |
|---|---|---|---|
| 1,220,876 | 3/1917 | Moore | 9/3 |
| 2,391,906 | 1/1946 | Kearny | 9/2 A |
| 2,456,086 | 12/1948 | Schwall, Jr. | 9/11 A |
| 3,056,980 | 10/1962 | Holladay | 9/13 |

*Primary Examiner*—Trygve M. Blix
*Assistant Examiner*—Sherman D. Basinger
*Attorney, Agent, or Firm*—Koenig, Senniger, Powers and Leavitt

[57] ABSTRACT

An inflatable boat comprising inner inflatable tubes in an outer tube, the inner tubes and the outer tube being fabricated from flat sheet stock by a method involving stitching a bottom seam of the outer tube with the outer tube in place on the inflated inner tubes.

4 Claims, 9 Drawing Figures

INFLATABLE BOAT

BACKGROUND OF THE INVENTION

This invention relates to inflatable boats, and more particularly to a type of inflatable boat sometimes referred to as an inflatable dinghy having an endless tubular hull.

Examples of such boats are found in U.S. Pat. Nos. 2,456,086, 3,212,111 and 3,125,770. Reference may also be made to U.S. Pat. No. 3,628,206.

SUMMARY OF THE INVENTION

Among the several objects of the invention may be noted the provision of an inflatable boat of improved economical construction; the provision of such a boat of such construction as to allow the use of a fabric in the hull of the boat and seams for the fabric that do not have to be air-tight; and the provision of such a boat wherein various parts are cut from flat stock thereby simplifying production.

In general, an inflatable boat of this invention comprises at least one inner inflatable tube and an outer tube surrounding the inner tube, said inner tube per se being a straight tube of air-impervious flexible sheet material having its ends closed, and said outer tube comprising a length of flexible sheet material surrounding the inner tube with the longitudinal margins of said length of outer tube material seamed together to constitute it as a tube. In making the boat, an inflatable tube which is to constitute an inner tube of the boat and is assembled with fabric which is to constitute an outer tube of the boat, the inflatable tube being inflated, margins of the fabric extending in the direction of the length of the inner tube being brought together into inside-face-to-inside-face engagement and extending outwardly from the tube, and stitching said margins together with a stitch permitting said margins, on further inflation of the inner tube, to lie against the inner tube with their edges opposed to one another.

Other objects and features will be in part apparent and in part pointed out hereinafter.

BRIEF DESCRIPTION OF THE DRAWINGS

Corresponding reference characters indicate corresponding parts throughout the several views of the drawings.

DESCRIPTION OF THE PREFERRED EMBODIMENT

Figure 1:
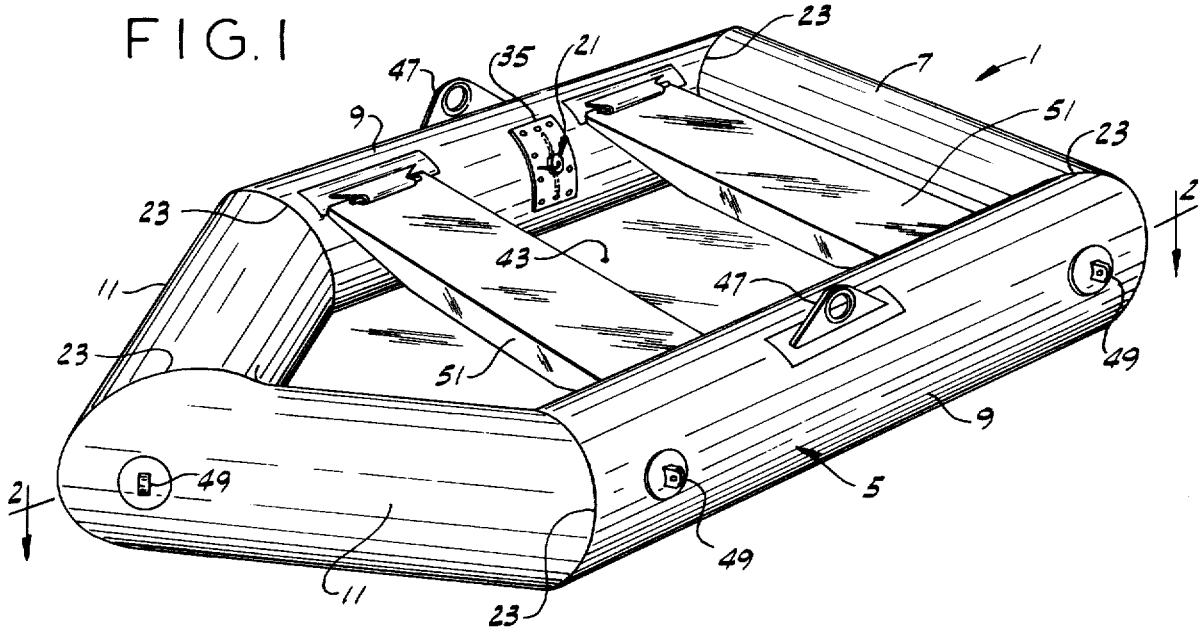
FIG. 1 is a perspective of an inflatable boat of this invention.
Figure 2:
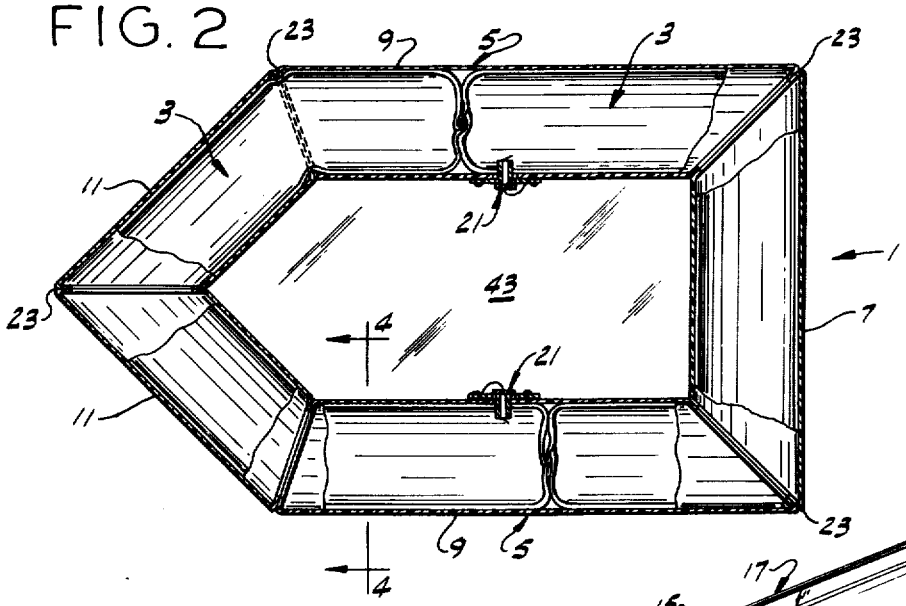
FIG. 2 is a horizontal section on line 2—2 of FIG. 1.
Figure 3:
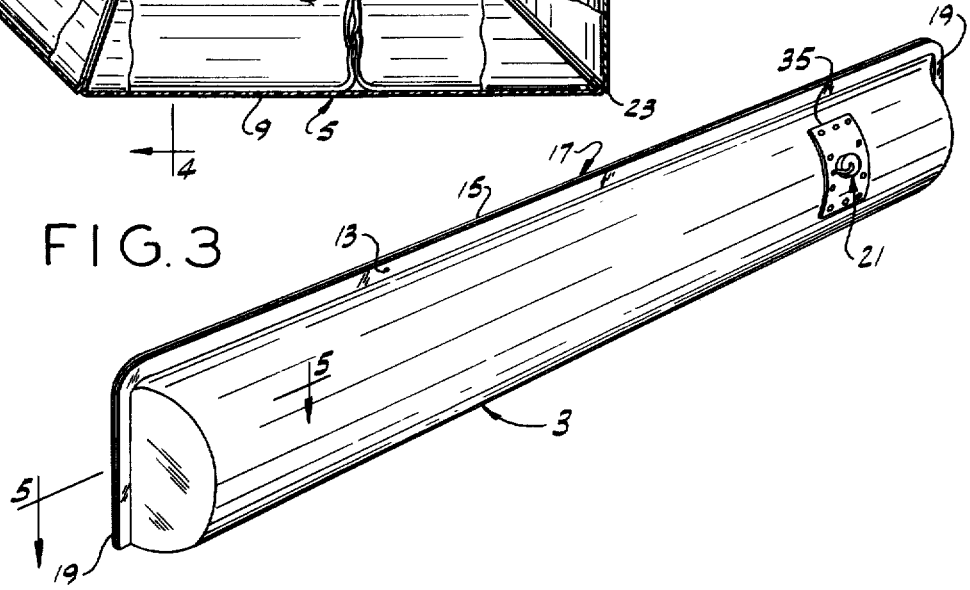
FIG. 3 is a perspective of an inner inflatable tube of the boat.
Figure 4:
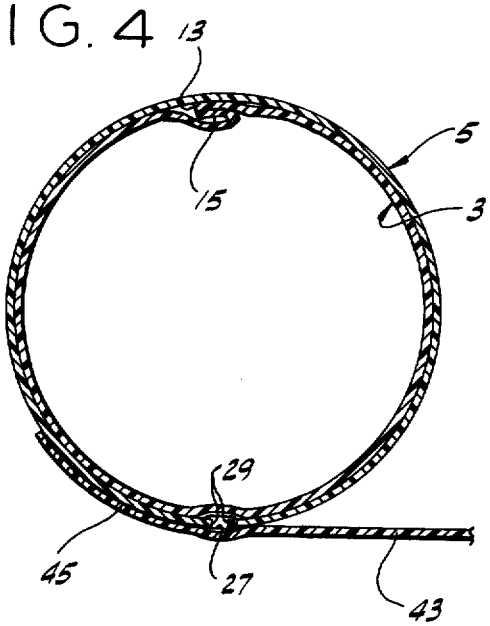
FIG. 4 is a vertical section on line 4—4 of FIG. 2.
Figure 5:
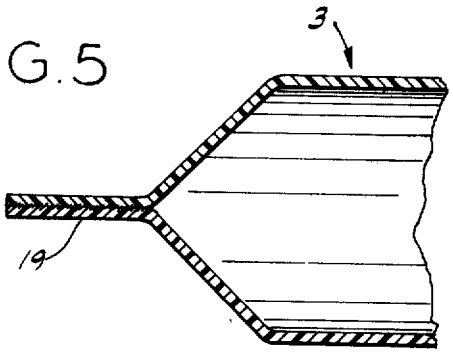
FIG. 5 is a horizontal section on line 5—5 of FIG. 3.
Figure 6:
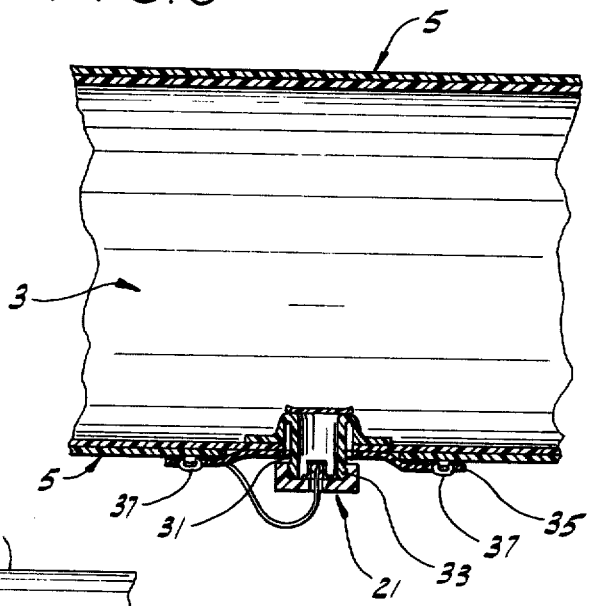
FIG. 6 is an enlarged fragment of FIG. 2.
Figure 7:
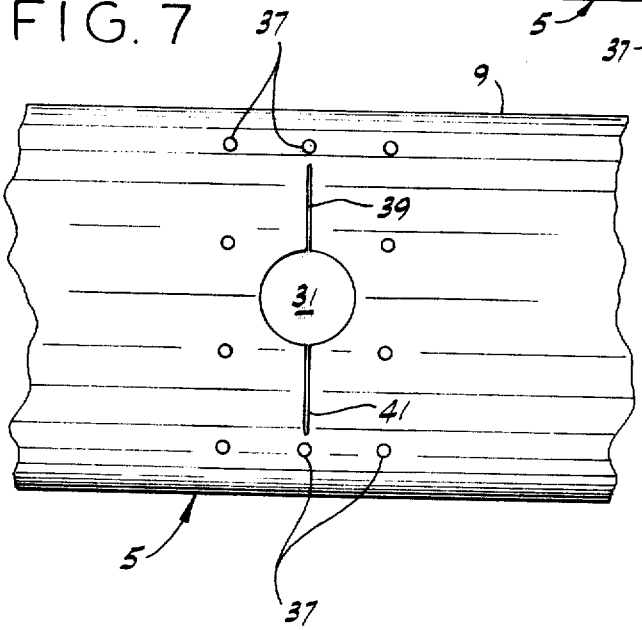
FIG. 7 is a view showing an opening in the outer tube of the boat for an air valve.

Referring to the drawings, there is indicated at 1 in FIGS. 1 and 2 an inflatable boat of this invention, comprising two inner inflatable tubes 3 and an outer tube 5 surrounding the inner tubes. The outer tube (which may also be referred to as the outer shell) is of endless form, having a stern section 7, left and right side sections each designated 9, and left and right bow sections each designated 11 angled toward one another in forward direction and meeting generally in the fore-to-aft central plane of the boat. Each inner inflatable tube 3 per se is a straight tube (see FIG. 3) of air-impervious material, e.g., air-impervious vinyl plastic sheet adapted to be heat-sealed. Each tube 3 comprises a straight length of such material formed into a tube with its longitudinal margins 13 and 15 (see FIGS. 3 and 4) brought together and sealed to form a longitudinal seam 17 and having its ends heat-sealed together to form end seams as indicated at 19. As illustrated, the longitudinal seam 17 and the end seams are face-to-face seams. Each of the inflatable tubes has a conventional air valve 21 (for inflating the tube) shown as located adjacent one end of the tube.

Figure 8:
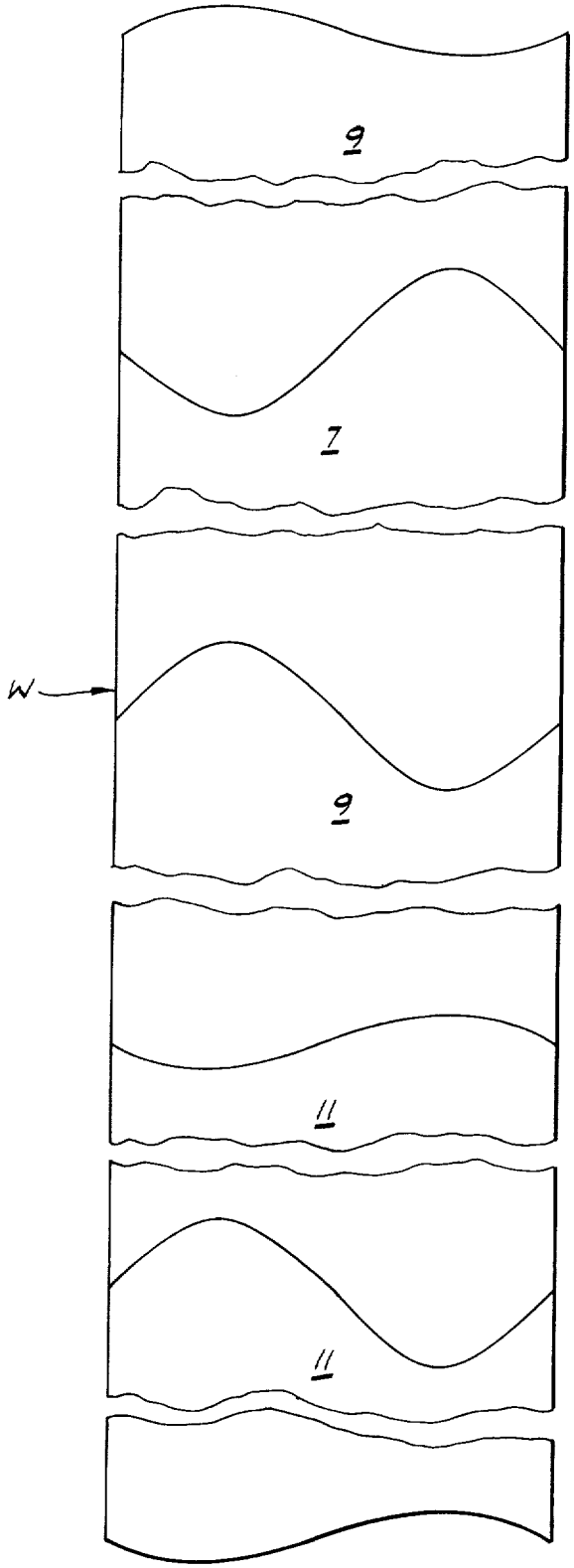
FIG. 8 is a view showing how sections of fabric for the outer tube are cut from a web.

Each section of the outer tube 3 is initially cut as a flat unfolded blank from a web of fabric such as vinyl coated nylon (e.g., 14 oz. vinyl coated nylon) which need not be completely air-impervious, but which is preferably water-impervious, the web having a width corresponding generally to the desired full inflated diameter of the sections. FIG. 8 illustrates how these sections may be cut from a web W with the cuts developed to form the necessary miter seams at the junctions of the sections with allowance of material for making these seams. Each of these miter seams is indicated at 23 in FIGS. 1 and 2, five such seams being provided, two between the ends of the stern section 7 and the aft ends of the side sections 9, two between the forward ends of the side sections 9 and the aft ends of the bow sections 11, and one between the forward ends of the bow sections 11.

Figure 9:
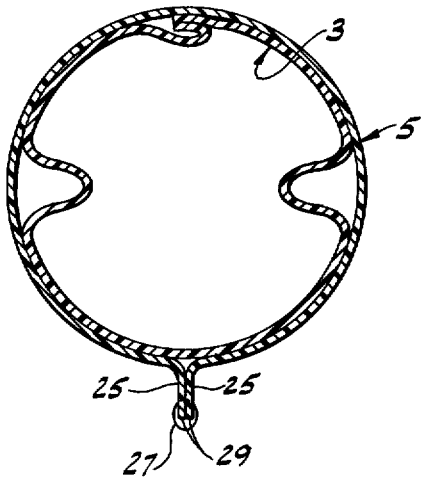
FIG. 9 is a vertical section illustrating a step in the manufacture of the boat.

The five fabric blanks are joined together end-to-end in the five-sided form of the boat by means of stitched face-to-face seams at 23, being formed into a tubular five-sided body 5 in the course of this operation with the side margins of each blank (which were the side margins of the web) unjoined at the bottom of the body. Thus, the five tubular sections have inwardly directed end margins stitched together in face-to-face relation at 23. The five-sided fabric body 5 is assembled with the two inner tubes 3 arranged end-to-end therein, and the inner tubes 3 are inflated to an extent somewhat less than full inflation to expand the fabric body to generally cylindrical form with the margins 25 of the fabric extending outwardly from what becomes the bottom of the boat in face-to-face relation (see FIG. 9). These margins are then whip-stitched together as indicated at 27 in FIG. 9 all around the five-sided body 5, the whip stitching being such as to permit the margins 25, on further inflation of the inner tubes 3, to lie generally flat against the inner tube with their edges 29 opposed to one another and contiguous. The stitching may be carried out on a Merrow sewing machine and provides a flat sewn seam effect.

Each of the left and right side sections 9 of the outer tube 5 has an opening 31 on the inside thereof for the air valve 21 of a respective inner tube 3. The valve has a threaded nipple 33 extending from the inner tube 3 through this opening 31. A closure flap 35 attached to the inner tube 3 at the base of the nipple 33 of the valve 21 overlies the outer tube 5, snap fasteners being provided as indicated at 37 for fastening it to the outer tube. This flap may be made, for example, of the same material as the outer tube 1. Each opening 31 is circular with slits 39 and 41 extending up and down therefrom, and each of the inner tubes 3 is removable (and replaceable) through the respective opening and slits.

The boat 1 has a floor 43, which may be of vinyl coated nylon, for example, secured by suitable adhesive all around its margin at 45 to the outer tube 5. Suitable oarlocks 47 are provided on top of the side sections 9 of the tuber tube 5, and rings 49 for a hand line (not shown) may be provided on the outside of each side section. Seats as indicated at 51 may be attached in suitable manner to the side sections 9.

In view of the above, it will be seen that the several objects of the invention are achieved and other advantageous results attained.

As various changes could be made in the above constructions without departing from the scope of the invention, it is intended that all matter contained in the above description or shown in the accompanying drawings shall be interpreted as illustrative and not in a limiting sense.

What is claimed is:

1. An inflatable boat comprising an outer tube having a stern section, side sections extending forward from opposite ends of the stern section at opposite sides of the boat, and bow sections angled toward one another from the forward ends of the side sections and meeting generally in the fore-to-aft central plane of the boat, and a plurality of inner inflatable tubes arranged end-to-end in said outer tube, each inner tube comprising a straight length of air-impervious flexible sheet material formed into a tube with its longitudinal margins brought together and sealed to form a longitudinal seam, and its ends sealed together to form end seams, each inner tube extending through a plurality of said sections, each inner tube having an inflation valve and said outer tube having openings for said inflation valves, and each inner tube being removable, when deflated, from the outer tube through the respective opening, the stern section, each side section and each half of the bow section of the outer tube each comprising a separate tubular section of said outer tube material, said separate tubular sections being stitched together at respective abutting ends thereof.

2. An inflatable boat as set forth in claim 1 wherein said tubular sections of said outer tube material have inwardly directed end margins stitched together in face-to-face relation.

3. An inflatable boat as set forth in claim 1 wherein each outer tube section comprises a length of flexible sheet material with the longitudinal margins thereof stitched together in such manner that, on inflation of the inner tubes and expansion of said sections, the margins of the length of the material in each said section lie against an inner tube with their edges opposed to one another and contiguous.

4. An inflatable boat as set forth in claim 3 wherein the longitudinal edges of each of said lengths of outer tube material are stitched together by a whip stitch passing over and under the edges of said material and extending through the margins of said material.

* * * * *